United States Patent [19]

Seidler

[11] Patent Number: 4,752,250

[45] Date of Patent: Jun. 21, 1988

[54] COMPLIANT CONNECTOR

[75] Inventor: Jack Seidler, Flushing, N.Y.

[73] Assignee: American Specialties Corp., Flushing, N.Y.

[21] Appl. No.: 68,789

[22] Filed: Jun. 25, 1987

Related U.S. Application Data

[63] Continuation of Ser. No. 880,934, Jun. 25, 1986, abandoned, which is a continuation of Ser. No. 698,386, Feb. 5, 1985, abandoned, which is a continuation-in-part of Ser. No. 556,775, Dec. 1, 1983, abandoned.

[51] Int. Cl.[4] ..... H01R 13/428

[52] U.S. Cl. ..... 439/751; 29/882; 439/82

[58] Field of Search ..... 29/874, 882; 439/81, 439/82, 751, 825–827, 873

[56] References Cited

U.S. PATENT DOCUMENTS

| | | | |
|---|---|---|---|
| 2,064,545 | 12/1936 | Kleinmann et al. | 339/252 P |
| 2,472,131 | 6/1949 | Toth et al. | 339/221 M |
| 2,994,057 | 7/1961 | Donohue et al. | 339/221 R |
| 3,031,641 | 4/1962 | Camzi | 339/252 P |
| 3,268,851 | 8/1966 | Mancini | 339/221 R |
| 3,368,188 | 2/1968 | Olsson | 339/220 R |
| 3,601,763 | 8/1971 | McNutt | 339/221 M |
| 3,634,819 | 1/1972 | Evans | 339/221 R |
| 3,764,955 | 10/1973 | Ward | 339/220 R |
| 4,272,149 | 6/1981 | Gallusser et al. | 339/221 R |
| 4,384,757 | 5/1983 | Andrews, Jr. et al. | 339/221 R |

FOREIGN PATENT DOCUMENTS

| | | | |
|---|---|---|---|
| 587046 | 10/1933 | Fed. Rep. of Germany | 339/252 P |
| 280689 | 11/1927 | United Kingdom | 339/252 P |
| 411383 | 6/1934 | United Kingdom | 339/252 P |
| 1178830 | 1/1970 | United Kingdom | 339/252 R |

*Primary Examiner*—Gil Weidenfeld
*Assistant Examiner*—Gary F. Paumen
*Attorney, Agent, or Firm*—Darby & Darby

[57] ABSTRACT

An electrical connector post or pin for insertion into a hole in a printed circuit board to establish contact with a conductive lining in said hole, the connector being constituted by an elongated flat blank of conductive material bent or folded and shaped to have a board engaging zone intermediate its ends.

7 Claims, 1 Drawing Sheet

COMPLIANT CONNECTOR

This application is a continuation of Application Ser. No. 880,934, filed June 25, 1986, now abandoned, which is a continuation of application Ser. No. 698,386 filed Feb. 5, 1985, now abandoned, which in turn is a continuation-in-part of application Ser. No. 556,775 filed Dec. 1, 1983, now abandoned.

This invention relates to contact, connector or terminal elements for use with electronic circuit boards having perforations which are lined with conductive material, as part of a circuit printed on one or both sides of the board.

BACKGROUND OF THE INVENTION

In the electronic equipment industry, an important problem arises in the rapid and accurate assembly of perforated printed circuit (PC) boards with connector posts, pins, terminals or other elements for connection to other components in th circuit. The holes in a circuit board are commonly either drilled or punched and some or all of the holes may then be lined with a plating of conductive material, in electrical contact with one or both of the circuits printed on the adjacent board surfaces. The holes are very small and their diameters may not be uniform, either before or after plating, so that connector posts or pins of a fixed uniform size cannot be relied on to provide uniformly good electrical contact. A post which is smaller than the hole may fail to make a good electrical connection, while forcing a post into a smaller hole can damage the board and/or deform the post.

OBJECTS OF THE INVENTION

It is accordingly an object of the invention to provide a connector post or pin having a cross-section of such configuration and size that it will make good electrical contact with the plating in a circuit board hole having maximum diameter and will also be able to contract as may be required upon introduction into a hole of small size, while continuing to maintain good electrical contact with the plating in the hole.

It is a further object of the invention to provide a connector post or pin having a compliant portion between its end portions, said compliant portion being adapted to make good electrical contact with the plated surface of any circuit board hole into which it may be introduced.

It is another object of the invention to provide a design for the cross-section of an intermediate portion of a connector post or pin which is adaptable both to a post or pin intended to engage in a circuit board hole without substantial penetration of the board, and to a post or pin intended to engage in a circuit board hole and to extend beyond the board for attachment to some other element of the intended circuit.

It is a still further object of the invention to provide certain improvements in the form and arrangement of the structural features by which the above named and other objects may effectively be attained.

SUMMARY OF THE INVENTION

The invention, in each of its embodiments, resides in the provision of an intermediate portion of the connector which is bent or folded, and provided with slits or slots, to form a more or less tubular portion which presents an effective diameter large enough to have a snug interference fit with the wall of a plated hole, of any anticipated diameter, in a printed circuit board. The enlarged intermediate portion may have an outer surface of partial cylindrical form or may be completely cylindrical, or oval in cross-section. In no case does the formation of slits or slots reduce materially the conductive capacity of the connector.

BRIEF DESCRIPTION OF THE DRAWINGS

Practical embodiments of the invention are shown in the accompanying drawings wherein.

The connector or terminal posts or pins illustrated in FIGS. 1 to 9 are adapted for use particularly in situations where no connection to the lower end of the element is required. In each case it will be understood that the upper end of the element is integral with the stem, whether shown or not, to be connected into an electronic circuit.

Figure 1:
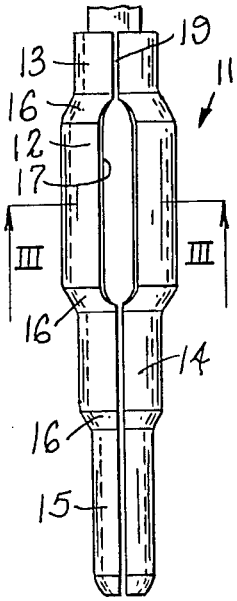
FIG. 1 represents a detail elevation of a post or pin contact or terminal wherein the intermediate portion is provided with longitudinal slots to permit an increase in diameter.
Figure 2:
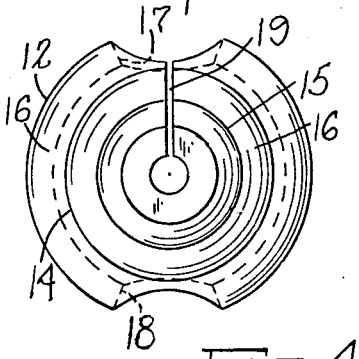
FIG. 2 represents a bottom end view of the post or pin contact or terminal shown in FIG. 1.
Figure 3:
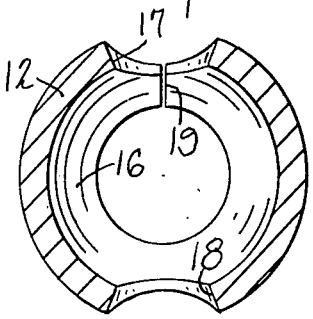
FIG. 3 represents a section on the line III—III of FIG. 1.

The post or pin element 11, shown in FIGS. 1 to 3, is made from a flat blank which is formed into a cylinder having a larger diameter portion 12, between shorter sections 13, 14 of an intermediate diameter and a snub-nosed lower end section 15 with a smaller diameter. Tapering transition zones 16 are formed between 12–13, 12–14 and 14–15. The larger portion 12 is provided with diametrically opposite longitudinal slots 17, 18, the slot 17 being conveniently located along the seam line 19, constituted by the meeting edges of the folded blank and the slot 18 extending along at least the larger diameter portion 12 and transition zones 16, but not along the entire intermediate diameter portions 13, 14 or end section 15, so that the unitary nature of the element is preserved. The diameter of the larger portion 12 is selected to be slightly greater than the maximum diameter likely to be encountered in a plated hole of a PC board. Since each end of each slot 17, 18 extends through the adjacent transition zone 16, the remaining walls of the larger portion 12 are compliant enough to fit readily into any normal PC board holes and to maintain good contact with the conductive lining thereof. The small diameter end section 15 is adapted to lead the post or pin into its intended hole and the tapered transition zones facilitate entry of the element snugly into holes of varying diameters.

Figure 4:
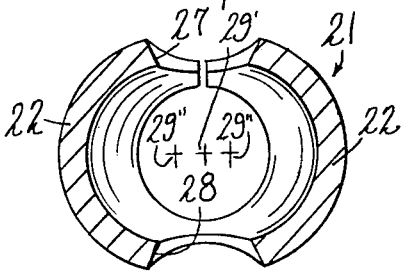
FIG. 4 represents a section, as in FIG. 3, of a slightly modified post or pin contact or terminal.
Figure 4A:
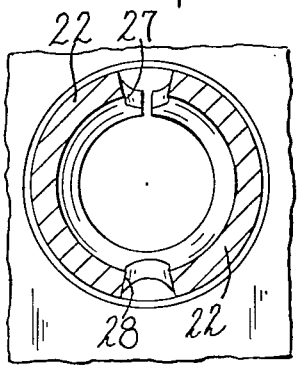
FIG. 4A represents a section, as in FIG. 4, showing the post or pin contact or terminal of FIGS. 3 and 4 inserted in a hole in a PC board.

FIG. 4 shows a cross-section of a slightly modified post or pin terminal or contact 21. As in FIGS. 1 to 3, the contact is formed from a flat blank, which is first bent into a generally cylindrical form with a seam where the edges of the blank abut. A slit is cut in the diametrically opposite wall, preferably only in the larger diameter zone 22, as in FIGS. 1–3. The slits are enlarged into slots 27, 28 by moving the wall portions 22 apart. Thus, the walls of the portions 22, separated by slots 27, 28, are not concentric with the whole unit, as in FIG. 3, but in cross section are substantially in the shape of semi-circular arcs on centers 29″ offset from the unit center 29′. Each slot 27, 28 is an enlargement of a slit from which no material has been removed, the slit developed into slot 27 being the seam or gap between vertical edges of the blank. FIG. 4A shows the post or pin of FIG. 4 inserted in a PC board hole having a diameter of maximum compatibility, i.e., the post walls fitting closely against the wall of the hole.

In effect, the center enlarged zone of the connector element is formed by two spaced semi-cylinders. When put into the PC board hole, the two semi-cylinders are forced toward one another by the hole, and form essentially a full circle which engages the circular lining of the hole, thus mating with the hole over a maximum area. The resiliency of the connector material serves to make and maintain good electrical contact between the connector element and the hole lining.

This arrangement provides a number of advantages. No material is removed from the blank in the contacting zone, so that either greater current capacity is afforded, or else thinner material can be used for a given capacity. Also, the semi-circular arcuate walls 22 afford maximum contact area with the mating inner surface of the PC board hole. At the same time, the slots 27, 28 afford the necessary flexibility and resiliency to allow for inevitable variations in hole diameter, within the usual preset tolerance limits.

Figure 5:
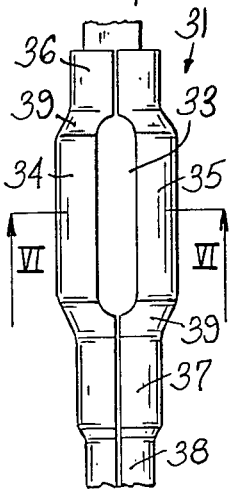
FIG. 5 represents a detail elevation of the intermediate portion of a post or pin contact or terminal wherein the increased effective diameter results from the bending of spaced wall portions into outwardly projecting U-shaped ridges, separated by longitudinal slots.
Figure 6:
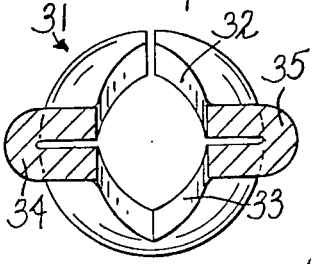
FIG. 6 represents a section on the line VI—VI of FIG. 5.

The post or pin 31, shown in FIGS. 5 and 6, has a compliant portion formed, as in FIGS. 1 to 3, from a flat blank which is bent into a cylinder and provided with longitudinally disposed, diametrically opposite slots, 32, 33. The walls of the cylinder between the slots are then crimped into 180° folded ridges or posts 34, 35 with U-shaped cross-sections, the outer surfaces of the ridges being spaced to project beyond the circumference of the cylinder from which they are formed, as clearly shown in FIG. 6. Above and below the slotted and crimped portion there remain cylindrical zones 36, 37 (comparable to sections 13, 14 in FIG. 1) with an intermediate diameter, and a lower end section 38 (like end section 15) is provided below the zone 37. Tapering transition zones 39 are provided between portions of varying diameters.

The post or pin contact 31 functions like post or pin contact 11 upon introduction into a PC board hole. The resiliency of the posts 34, 35 may be less than that of the compliant walls 12 (FIGS. 1–3), but that characteristic can be determined by selecting metal of an appropriate gauge.

Figure 7:
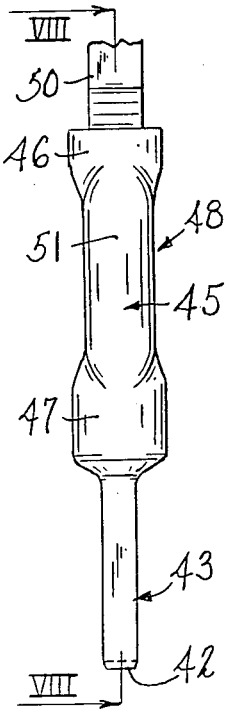
FIG. 7 represents a detail elevation of the intermediate portion of a port or pin contact or terminal wherein a final configuration similar to that shown in FIGS. 1 to 3 is achieved from an elongated blank which is folded 180° at the bottom end.
Figure 8:
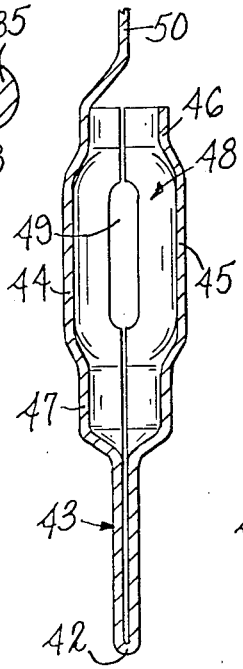
FIG. 8 represents a section on the line VIII—VIII of FIG. 7.
Figure 9:
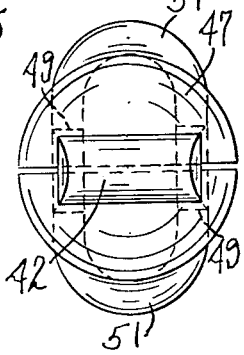
FIG. 9 represents a bottom end view of the post or point shown in FIG. 7, on an enlarged scale.

A somewhat different concept is introduced in the manufacture of the post or pin 41 shown in FIGS. 7, 8 and 9, namely the provision of a blank which can be folded on itself endwise to bring formed congruent semi-cylindrical shells together in facing relationship where they constitute a cylindrical body. The external appearance of the connector is quite similar to that of the connector shown in FIG. 1 but the difference in manufacturing technique is well illustrated in FIG. 8. The elongated blank has a narrow portion which, when sharply folded at 42, constitutes the 2-ply lower tail portion 43. Wider portions of the blank are shaped into the semi-cylindrical shells 44, 45 having intermediate diameter portions 46, 47 above and below the larger diameter main body 42. The edges of the shells are cut away in the zone of the body 48 to provide longitudinal slots 49 along the line of cleavage between the facing edges of the folded blank. A stem 50 is integral with the shell portion 44 and extends beyond the connector in any desired configuration for association with other elements of the circuit. The body 48 is somewhat flattened to assume an oval cross-sectional shape, as shown in the bottom end view of FIG. 9, the protruding curved ends 51 of the oval assuring good electrical contact with the lining of a PC board hole into which the connector is inserted.

In each of the embodiments shown in FIGS. 5 to 9, the cylindrical connector body is provided with a non-circular portion having a major outside diameter larger than the diameter of any plated (lined) hole likely to be associated. The structure of each connector body is such that it is effectively compliant (resilient) in the direction of its major diameter, such resiliency being a specific form of the multi-directional resiliency (along a plurality of radii) exhibited by the connectors shown in Application Ser. No. 556,775, of which this application is a continuation-in-part.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. An electrical connector element for insertion into a hole in a printed circuit board to establish contact with a conductive lining in said hole, the connector element being tubular and formed from an elongated flat blank of uniform thickness resilient conductive material, having a single slit of predetermined length formed longitudinally and substantially centrally in said blank without removal of material, said blank also having an unslitted portion integral with and adjoining said slit at one end thereof, the blank being rolled longitudinally about a longitudinal axis to place its edges substantially in abutment, said connector element having a uniform cross-section cylindrical portion formed from said unslitted blank portion and also having an adjoining uniform cross-section board-engaging zone of enlarged transverse extent constituted by two curved substantially semi-cylindrical segments of substantially semi-circular cross-section with effective resiliency therebetween and along a diameter of said zone, said semi-cylindrical segments having substantially the same radius of curvature as said hole, the semi-cylindrical segments of the boardengaging zone being separated by two diametrically opposite longitudinal slots, one formed by deforming said slit without removal of material and the other slot being formed at the abutting edges of said rolled blank, said slots extending throughout substantially the entire length of said enlarged zone, each of said semi-circular segments having a center of curvature offset laterally from the longitudinal axis of the connector element, the cross-sectional arcuate extent of each semi-cylindrical segment being large in relation to the arcuate width of said slots whereby said segments are resiliently urged apart by the resilience of said material to make electrical contact with said hole conductive lining over a substantial portion of the surfaces of said segments and lining.

2. An electrical connector element according to claim 1 wherein each of said segments in the board-engaging zone is flattened to form a substantially 180 degree flattened fold extending along said segment, said folds being diametrically opposed.

3. A connector element as in claim 1 wherein said semi-cylindrical segments are of substantially uniform radial thickness.

4. The method of providing an electrical connector element for insertion into a hole in a printed circuit board to establish contact with a conductive lining in said hole, comprising the steps of providing an elongated flat strip of resilient conductive material of substantially uniform thickness, forming a slit longitudinally along a portion of said strip, substantially centrally thereof, and without removal of material, bending said strip about a longitudinal axis into a tubular substantially cylindrical form to cause its lateral edges substantially to abut to form a seam, and with each segment of said strip between said slit and said seam being substantially circularly curved in cross-section, and substantially semi-cylindrical in shape, forming a portion of said seam and said slit into respective slots by moving said semi-cylindrical segments apart without substantial removal of material, to cause the center of curvature of a cross-section of each of said segments to be spaced on either side of said axis, the cross-sectional curved extent of each of said semi-cylindrical segments being large in relation to the corresponding curved extent of eachof said slots, whereby a connector element is formed having effective resiliency along a diametral direction with said segments forming a board-engaging zone adapted when inserted in a said hole to be pressed together substantially to conform to said hole, and resiliently to engage the wall of said hole to retain said connector element in contact wth said hole.

5. A method as in claim 4 further including forming each of said segments to have a laterally extending 180 degree fold, with said folds resiliently separated by said slots and adapted to engage the wall of a said hole when the contact element is inserted therein.

6. A product made by the method of claim 4.

7. A product made by the method of claim 5.

* * * * *

UNITED STATES PATENT AND TRADEMARK OFFICE

CERTIFICATE OF CORRECTION

PATENT NO. : 4,752,250

DATED : June 21, 1988

INVENTOR(S) : Seidler, Jack

It is certified that error appears in the above-identified patent and that said Letters Patent are hereby corrected as shown below: On the title page The name of the assignee appears incorrectly. Please change the name of the assignee to read -- North American Specialties Corp.

Signed and Sealed this

Eleventh Day of October, 1988

*Attest:*

DONALD J. QUIGG

*Attesting Officer*

*Commissioner of Patents and Trademarks*